US009719241B2

(12) United States Patent
Nybo et al.

(10) Patent No.: US 9,719,241 B2
(45) Date of Patent: Aug. 1, 2017

(54) METHOD FOR OPERATING A WASTEWATER PUMPING STATION

(71) Applicant: GRUNDFOS HOLDING A/S, Bjerringbro (DK)

(72) Inventors: Peter Jungklas Nybo, Randers SV (DK); Carsten Skovmose Kallesøe, Viborg (DK); Klaus Grønnegård Lauridsen, Viborg (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 243 days.

(21) Appl. No.: 14/133,938

(22) Filed: Dec. 19, 2013

(65) Prior Publication Data

US 2014/0178211 A1 Jun. 26, 2014

(30) Foreign Application Priority Data

Dec. 20, 2012 (EP) ..... 12198741

(51) Int. Cl.
*F04B 49/00* (2006.01)
*E03F 5/22* (2006.01)
*F04D 15/02* (2006.01)

(52) U.S. Cl.
CPC ..... *E03F 5/22* (2013.01); *F04D 15/029* (2013.01); *F04D 15/0218* (2013.01)

(58) Field of Classification Search
CPC ..... E03F 5/22; F04D 13/14; F04D 15/0218; F04D 15/029
See application file for complete search history.

(56) References Cited

U.S. PATENT DOCUMENTS 4,505,813 A * 3/1985 Graves ..... C02F 3/1242 210/104
4,594,153 A * 6/1986 Weis ..... E03F 5/22 210/104

(Continued)

FOREIGN PATENT DOCUMENTS

DK EP 2476907 A1 * 7/2012 ..... F04D 13/14
EP 1 559 841 A2 8/2005

(Continued)

*Primary Examiner* — Charles Freay
(74) *Attorney, Agent, or Firm* — McGlew and Tuttle, P.C.

(57) ABSTRACT

A method is provided for operating a wastewater pumping station of a wastewater pumping network. The pumping station includes a pump, that starts pumping if a level of a wastewater in a tank exceeds a first wastewater level, and the pump stops pumping if the level of the wastewater in the tank drops below a second level. The method includes determining a magnitude of a parameter ($P_{sys}$, Q, n, ΔP, $P_{electrical}$, cos ϕ, I) expressing the load of the wastewater pumping network. If it is determined that the magnitude of the parameter has passed a specified threshold, the pump is activated to start pumping in an energy optimization mode. A control unit is also provided for the wastewater pumping station of the wastewater pumping network, and a system is provided for centrally controlling a plurality of pumps of wastewater pumping stations in a wastewater pumping network.

20 Claims, 6 Drawing Sheets

(56) References Cited

U.S. PATENT DOCUMENTS 4,608,157 A * 8/1986 Graves ..... C02F 3/1242 210/104
4,999,117 A * 3/1991 Palmu ..... E03F 5/22 137/558
5,190,442 A * 3/1993 Jorritsma ..... F04D 15/0083 417/12
5,228,996 A * 7/1993 Lansdell ..... C02F 3/1263 210/605
5,422,550 A * 6/1995 McClanahan ..... H02P 5/50 318/103
5,466,127 A * 11/1995 Arnswald ..... F04D 13/086 417/38
5,591,010 A * 1/1997 Van Zyl ..... G05D 9/12 417/12
5,636,971 A * 6/1997 Renedo Puig ..... F04B 49/022 417/38
5,742,500 A * 4/1998 Irvin ..... F04D 15/0066 417/2
5,772,403 A * 6/1998 Allison ..... F04B 49/065 417/44.2
6,178,393 B1 * 1/2001 Irvin ..... F04D 15/0066 700/282
6,322,325 B1 * 11/2001 Belehradek ..... F04D 15/0218 417/2
6,378,554 B1 * 4/2002 Struthers ..... E03F 1/00 137/565.16
8,032,256 B1 * 10/2011 Wolf ..... E03F 5/22 137/552.7
8,036,838 B2 * 10/2011 Parkinson ..... F04D 15/0218 702/104
8,371,821 B1 * 2/2013 Mehr ..... F04B 47/06 417/12
8,594,851 B1 * 11/2013 Smaidris ..... G05D 9/12 137/101.19
8,920,131 B2 * 12/2014 Aspen ..... F04B 49/065 417/12
9,032,748 B2 * 5/2015 Lau ..... F04D 15/029 417/3
9,051,936 B2 * 6/2015 Kallesoe ..... F04D 13/14
2002/0090303 A1 * 7/2002 Scott ..... F04D 15/0209 417/36
2002/0114702 A1 * 8/2002 House ..... F04D 15/0218 417/40
2003/0235492 A1 * 12/2003 Mirsky ..... F04D 15/029 415/1
2006/0089752 A1 * 4/2006 Voigt ..... F04C 13/008 700/282
2009/0020173 A1 * 1/2009 Lau ..... F04D 15/029 137/565.01
2009/0283457 A1 * 11/2009 Buchanan ..... F04D 15/0218 210/86
2010/0064705 A1 * 3/2010 Chauvin ..... F04B 49/02 62/150
2012/0222994 A1 * 9/2012 Smaidris ..... C02F 1/008 210/97
2012/0267318 A1 * 10/2012 Hatten ..... C02F 1/727 210/744
2013/0153492 A1 * 6/2013 Amitai ..... C02F 3/006 210/602
2014/0048156 A1 * 2/2014 Smaidris ..... C02F 1/006 137/395
2015/0148972 A1 * 5/2015 Blaumann ..... F04D 1/04 700/282

FOREIGN PATENT DOCUMENTS

EP 1 559 841 B1 1/2008
EP 2 014 922 A2 1/2009
IT WO 2011088983 A1 * 7/2011 ..... F04D 13/14
WO WO 2011088983 A1 * 7/2011 ..... F04D 13/14

* cited by examiner

METHOD FOR OPERATING A WASTEWATER PUMPING STATION

CROSS REFERENCE TO RELATED APPLICATIONS

This application claims the benefit of priority under 35 U.S.C. §119 of European Patent Application EP 12 198 741.6 filed Dec. 20, 2012, the entire contents of which are incorporated herein by reference.

FIELD OF THE INVENTION

The invention relates to a method for operating a wastewater pumping station of a wastewater pumping network, as well as a control unit to control one or more pumps of the wastewater pumping network and a system for centrally controlling a plurality of pumps of wastewater pumping stations in a wastewater pumping network.

BACKGROUND OF THE INVENTION

Pumping stations are a natural part of the wastewater transport system including pressurized pumping stations, network pumping stations and main pumping stations Prefabricated pumping stations are mainly used in pressurized network system. A pumping station in such a pressurized system normally includes 1 or 2 grinder pumps, a level system, a controller, and a pumping station.

Where the wastewater cannot run by gravity each building or house will have a pumping station. The wastewater will then be transferred from the discharge units (showers, toilets, etc.) to a small pumping station. From there it will be pumped through small pressure pipes to a bigger pumping station or directly to a treatment plant. On each pressurized pipeline there can be connected up to 300 to 500 pressurized pumping stations.

However, when a couple of pumps run at the same time in a pressurized system, the pressure in the system will get higher than the pumps are able to overcome. This could result in the pumps pumping without moving any or only a very limited amount of wastewater before some of the other pumps have finished their pumping cycles. This is not ideal and can result in unnecessary energy losses.

The above system pressure problem will mainly occur during peak periods in the morning and evening depending on which application or building is connected to the pressure system.

SUMMARY OF THE INVENTION

Therefore, it is an object of the present invention to provide a method and system for operating a wastewater pumping station of a wastewater pumping network without unnecessary energy losses.

This object can be achieved by a method for operating a wastewater pumping station of a wastewater pumping network. According to the present invention, the method for operating a wastewater pumping station of a wastewater pumping network is provided. The wastewater pumping station comprising at least one pump, wherein the pump starts pumping if the level of the wastewater in a tank of the wastewater pumping station exceeds a first wastewater level, and the pump stops pumping if the wastewater level in the tank drops below a second level, wherein the method comprises determining the magnitude of a parameter [$P_{sys}$, Q, n, $\Delta P$, $P_{electrical}$, cos $\phi$; I] expressing the load of the wastewater pumping network, wherein if it is determined that the magnitude of the parameter expressing the load has passed a specified threshold, performing a step of activating the at least one pump to start pumping in an energy optimization mode. By the inventive method, the pump of the wastewater pumping station will be able to run in a way such that energy consumption will be as optimal as possible. Thus, although the pump will always run an emptying procedure when the wastewater in the tank exceeds a first high wastewater level (start level, safety mode), and will always stop pumping, if the wastewater level in the tank drops below a low second wastewater level (stop level), the pump may be run in an energy optimization mode between a third level between the first and second level in which the pump is controlled such that the energy consumption is minimized. I.e., when for example the pressure in the common pipeline of the wastewater pumping network is determined to be low, the pump may start pumping in an optimal manner rather than starting to pump when many pumps already are pumping in the network system so that the pressure in the common pipeline is high.

According to a preferred embodiment, in the energy optimization mode if it is determined that the pressure exceeds a specified upper pressure limit, the at least one pump is deactivated. Thus, it may be prevented that the pump is operating without moving any wastewater into the common pipeline because the pressure in the latter is already too high.

Further, it is preferred that the method comprises a step of increasing or decreasing, in the energy optimization mode, the speed of the at least one pump in accordance with the pressure detected. Increasing and decreasing the speed of the pump in accordance with the pressure detected in the outlet or the common pipeline, respectively, may further save energy.

Preferably, the pressure is a fluid pressure of the wastewater in the common outlet pipe of the wastewater pumping network, and the step of determining the pressure is carried out by measuring the pressure, in particular, by means of a pressure sensor for measuring an absolute pressure or a pressure difference, in the common outlet pipe to which the wastewater pumping station is connected.

According to a further preferred embodiment, the step of determining the pressure is carried out by determining a pressure difference across the at least one pump, and determining a wastewater level in the tank in which the at least one pump is accommodated.

According to still a further preferred embodiment, the step of determining the pressure difference across the at least one pump comprises determining the flow of pumped wastewater, in particular, determining the flow of pumped wastewater on the basis of changes in the wastewater level in the tank.

Moreover, it is preferred, if the step of determining the pressure comprises determining the power of a drive motor used for driving the at least one pump, and/or a power factor (cos(($\phi$)) wherein $\phi$ is the phase angle between current (I) and voltage (U), and/or a motor current (I).

It is also advantageous, when the method further comprises a step of individually controlling the at least one pump on the basis of the determined pressure by a local pump controller.

Alternatively, the at least one pump may be controlled centrally from a central control station of the wastewater pumping network.

In still a further preferred embodiment, the wastewater pumping network comprises a plurality of wastewater pumping stations.

According to the present invention, there is provided a control unit for a wastewater pumping station of a wastewater pumping network comprising a plurality of wastewater pumping stations, the wastewater pumping station comprising at least one pump adapted to pump wastewater from a tank to a common outlet pipe of the wastewater pumping network, wherein the control unit is adapted to control the pump to start pumping if a wastewater level exceeds a first level in the tank, and to stop pumping if the level of the wastewater drops below a second level in the tank, wherein the control unit is adapted to control the activity of the at least one pump in an energy optimization mode on the basis of a parameter [$P_{sys}$, Q, n, ΔP, $P_{electrical}$, cos φ; I] determined which expresses the load of the wastewater pumping network, wherein if it is determined that the magnitude of the parameter expressing the load has passed a specified threshold, the control unit is adapted to activate the at least one pump to start pumping. By using the inventive control unit, the pump or pumps may be controlled such that they run in an optimal manner using as little energy as possible in the energy optimization mode.

According to a preferred embodiment, the control unit is further adapted to increase or decrease the speed of the at least one pump on the basis of the pressure determined in the outlet pipe to further save energy.

Also according to the present invention, a system for centrally controlling a plurality of pumps of wastewater pumping stations in a wastewater pumping network is provided, wherein the system comprises a central control unit as outlined above, having the advantages with respect to energy consumption already described.

The present invention will become more fully understood from the detailed description given herein below and the accompanying drawings, which are given by way of illustration only, and thus, they are not limitative of the present invention. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Other objects and further scope of applicability of the present invention will become apparent from the detailed description given hereinafter. It should be understood, however, that the detailed description and specific examples, an indication of preferred embodiments of the invention, are given by way of illustration only, since various changes and modifications within the spirit and scope of the invention will be become apparent to those skilled in the art from this detailed description.

Figure 1A:
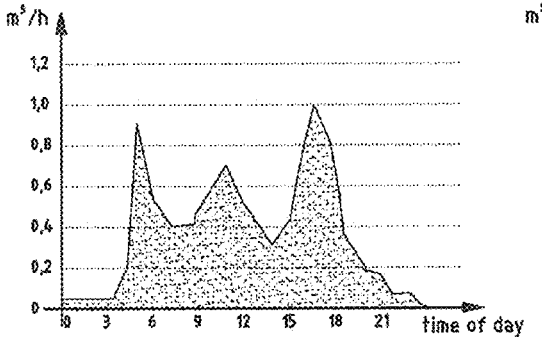
FIG. 1A is a typical daily profile on when the usage of water is high, which means that wastewater flows into the pumping stations.
Figure 1B:
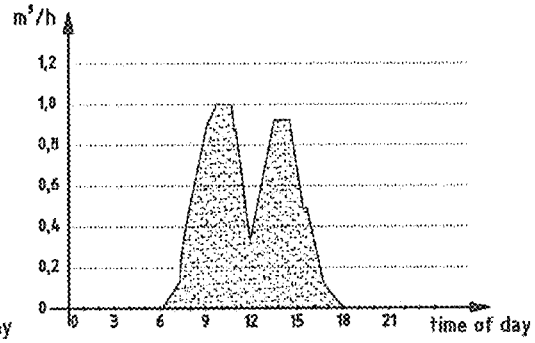
FIG. 1B is another typical daily profile on when the usage of water is high, which means that wastewater flows into the pumping stations.

Referring now in detail to the drawings, FIG. 1A and FIG. 1B show two typical daily profiles, respectively, on when the usage of water is high, which means that wastewater flows into the pumping stations. In each of the diagrams, the water usage in $m^3$/hour (y-axis) is plotted against the time of day (x-axis). In FIG. 1A on the left hand side, a discharge pattern for flats, a restaurant and a kitchen in a hotel is illustrated. As can be seen, there are three peaks during the day where the water usage is very high, namely, at about six o'clock (AM) in the morning, at about 12 o'clock, and in the evening at about 6 o'clock (PM). On the right hand side in FIG. 1B, a discharge pattern for a laundry in a hotel is shown wherein it can be seen that there are only two peaks, namely, at about 9 o'clock in the morning (AM) and at about three o'clock (PM) in the afternoon. During these peak water usage times, a very high system pressure can be expected in the common pipeline to which the wastewater stations of these buildings are connected so that pumping wastewater into the pipeline may be rather ineffective and, thus, energy consuming. Instead, at times when there is no high water usage, e.g., during the night time, the system pressure in the common pipeline will be very low due to the low water consumption and therefore few operating pumps. Thus, pumping wastewater out of the wastewater pumping stations will be more effective during these times.

Figure 2:
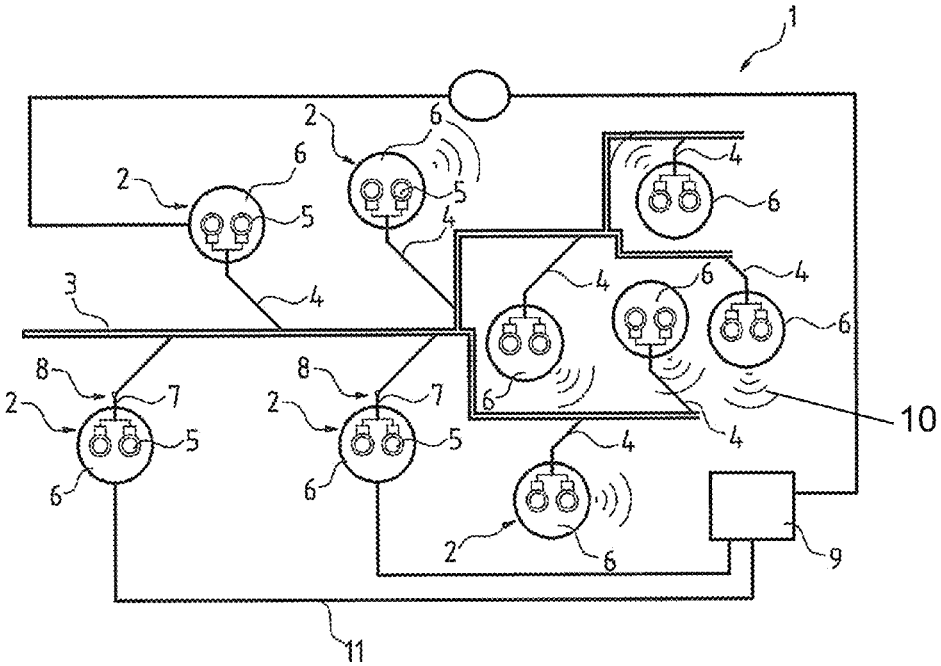
FIG. 2 is a schematic view showing a wastewater pumping network according to an embodiment.

FIG. 2 shows a pressurized wastewater pumping network 1 according to an embodiment. As can be seen from FIG. 2, in the wastewater pumping network 1, a plurality of wastewater pumping stations 2 are connected in a network via respective connection pipes 4 to a common outlet pipe 3. Each of the wastewater pumping stations 2 in the embodiment shown comprises two pumps 5 (e.g. Grundfos' SEG pump type) for pumping wastewater out of respective tanks 6 in which the pumps 5 are accommodated. Each tank 6 has an outlet 7 which opens into the respective connection pipe 4 which in turn leads to the common outlet pipe 3. Downstream the outlet 7, a pressure sensor 8 for detecting the pressure in the common outlet pipe 3 may be installed. Further, a central control unit 9 is provided for centrally controlling the pumps 5 to start pumping when the pressure in the common outlet pipe 3 is low and to stop pumping when the pressure in the common outlet pipe 3 is high. Specifically, the control unit 9 controls the activity of the pumps 5 in an energy optimization mode on the basis of a pressure determined in the common outlet pipe 3 such that if the pressure drops below a specified lower pressure limit, a specified number of pumps 5 start pumping, and if the pressure exceeds a specified upper pressure limit, the control unit 9 deactivates the specified number of pumps 5 so as to stop pumping. Thus, each of the pits is controlled such that the energy consumption is minimized since in the energy optimization mode pumping is only carried out when the pressure in the common outlet pipe 3 is low. Further, the control unit 9 communicates with the pumps 5 either in a wireless manner, as indicated by reference numeral 10 in FIG. 2, or via a cable connection 11.

Figure 3:
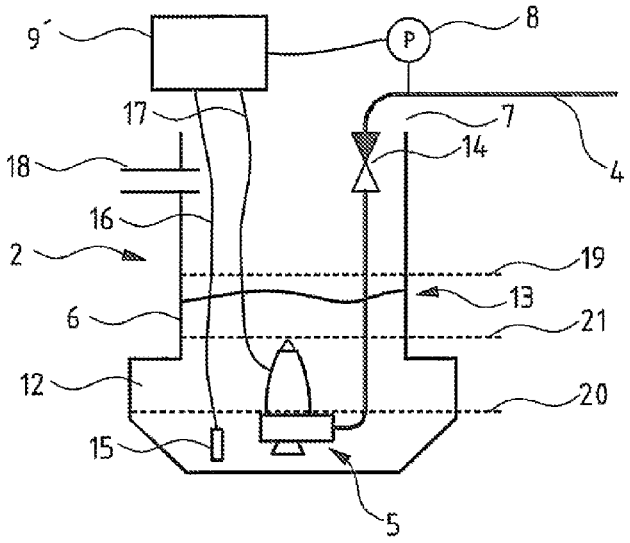
FIG. 3 is a schematic view showing an embodiment of a wastewater pumping station of the system according to an embodiment of the invention.

FIG. 3 shows a single wastewater pumping station 2 from the wastewater pumping network 1 shown in FIG. 2 according to an embodiment. The wastewater pumping station 2 comprises a tank 6 in which a grinder pump 5 of the SEG pump type is arranged. In the tank 6, wastewater 12 is present having a certain wastewater level 13. The wastewater 12 is introduced into the tank 6 through an inlet 18. From an outlet of the pump 5, a connection pipe 4 runs through an outlet 7 of the tank 6 to the common outlet pipe 3 which is shown in FIG. 2. A pressure sensor 8 detects the pressure in the connection pipe 4 upstream of a non-return valve 14 which opens and closes the connection pipe 4. Further, in the tank 6, a level sensor 15 is arranged which detects the wastewater level 13 in the tank 6. It should be noted that the level sensor can be of any kind. For example, instead of a level sensor, a simple standard level switch may be used just as well. The level sensor 15 and the pump 5 each are connected via respective wires 16, 17 to a local control unit 9' which controls the pump 5 in the wastewater pumping station 2 individually and locally according to the wastewater level 13 in the tank and the pressure in the common outlet pipe 3 (not shown here, see FIG. 2). I.e., the pump 5 is controlled so as to always start pumping when the level 13 of the wastewater 12 in a tank 6 exceeds a first wastewater level 19 which is called a "start level, safety" in order to run an emptying procedure. Also, the pump 5 is controlled to always stop pumping when the wastewater level 13 in the tank 6 drops below a second level 20 which is called a "stop level". Between the "start level, safety" and the "stop level", there is a third level 21 which is called the "start level, energy" at which the pump 5 may be controlled so as to start pumping in an energy optimization mode when a low pressure has been detected in the common outlet pipe 3 of the wastewater pumping network 1 (see FIG. 2).

The system pressure can be determined by direct measurement or can be estimated. It should be mentioned that the selection on how to ensure that the pumps run in the most optimal way depends on the level of control and communication connected to the installation. Instead of the embodiment shown here according to which the pump 5 is controlled by a local control unit 9', it is also possible to centrally control the pumps 5 in the network from a central control unit 9, as shown, e.g., in FIG. 2. In this case, an external pressure sensor measures the system pressure in the common outlet pipe 3 and the individual pumps 5 in the network will be started and stopped under control of the central control unit 9, taking the whole pressurized system in consideration. Moreover, another possibility is that the energy optimization algorithm is executed from the pump 5 itself to ensure that it runs in the most efficient and optimal manner. Further, in case an estimated pressure, i.e., a derived value, is used to indicate the system pressure, the pumps 5 may then be started and stopped also by a local pumping station controller. An extra minimum start level could be built below the maximum start level 19 ("start level, safety"). In this way, when the wastewater level 13 reaches the minimum start level 21 ("start level, energy"), the pump 5 could start up in intervals to evaluate if the pressure in the system is at an acceptable level for the pump to pump down to the stop level 20. If the pump 5 does not empty the pumping station 2 before the wastewater level 13 reaches the maximum start level 19, it will forcedly start pumping cycles.

Figure 4:
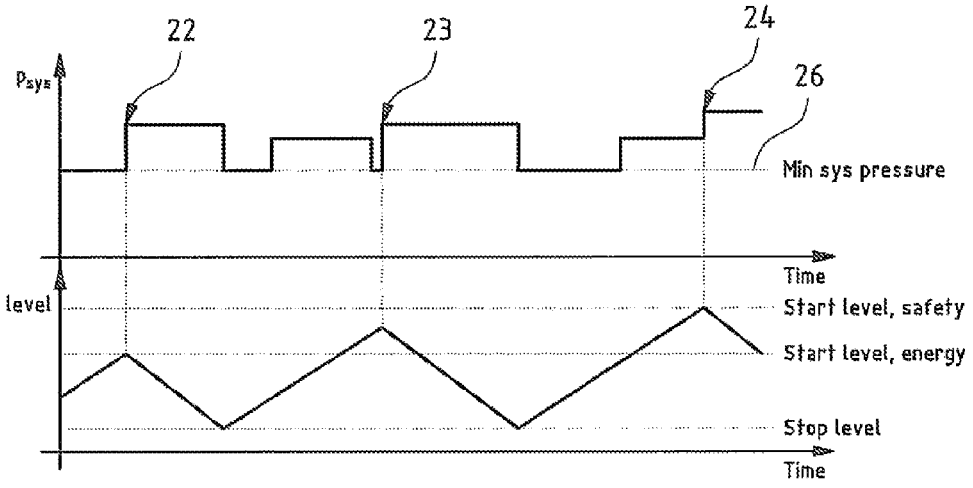
FIG. 4 is a graph showing a control example for a case in which a system pressure sensor is used.

FIG. 4 shows a control example for a case in which a system pressure sensor is used. Three different events 22, 23, and 24 are shown which activate a pump 5 to start pumping. The first event indicated by reference numeral 22 is a start of the pump 5 with no network activity where the wastewater level has reached the "start level, energy", namely, the third level 21 shown in FIG. 3 and the system pressure $P_{sys}$ which here is used as the parameter expressing the load of the wastewater pumping network (1) measured in the common outlet pipe 3 (see FIG. 2) is rather low and has passed a specified threshold which here is the minimum system pressure indicated by reference numeral 26 so that the pump 5 can pump wastewater 12 out of the tank 6 in the energy optimization mode. The second event indicated by reference numeral 23 is a start of the pump 5 after ended network activity where the wastewater level 13 is between the "start level, energy", namely, third level 21, and "start level, safety", namely first level 19 and the system pressure $P_{sys}$ still is low to ensure that the pump 5 might run efficiently. The third event indicated by reference numeral 24 is a forced start when the wastewater level 13 reaches the "start level, safety", the first level 19, in the tank 6 when wastewater needs to be pumped out of the tank 6 so as to avoid an overflow of the latter. It should be noted that the start event may be scaled with the system pressure such that an increasingly larger system pressure is accepted as the wastewater level gets closer and closer to the "start level, safety".

Figure 5:
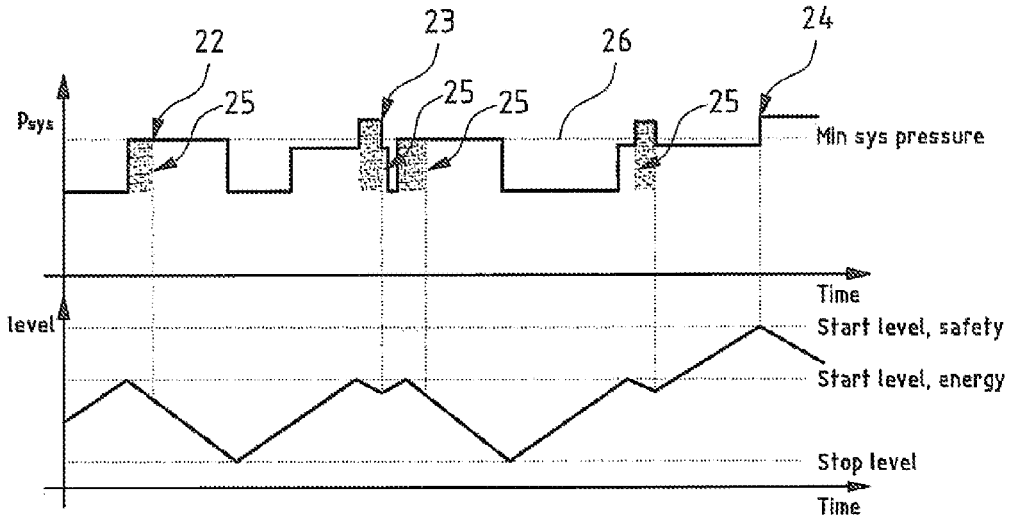
FIG. 5 is a graph showing another control example for a case in which the wastewater level and a difference pressure of the pump are used.

FIG. 5 shows another control example for a case in which the wastewater level and a difference pressure of the pump are used for controlling the pump 5. Again, the three events to activate the pump 5 to start pumping as explained with respect to FIG. 4 are indicated by reference numerals 22, 23, and 24. In this case, the necessary measurement cycles indicated by reference numeral 25 are shown in gray color. It should be mentioned that only when the pump 5 is running, the pressure is detectable. The detectable pressure values are marked with the thick parts in the upper solid line. According to this approach, however, it is not possible to measure the minimum pressure in the network but rather only the pressure when the pump 5 of a wastewater pumping station 2 is running. Therefore, this pressure is identified and compared to the actual pressure in the measurement cycles.

Further, it should be noted that the connection between the system pressure and combination of the level and difference pressure is given by the following equation:

$$P_{sys}=\Delta P+\rho g l$$

wherein ΔP is the pressure difference across the pump 5 (estimated pump pressure), ρ is the mass density of the waste water, g is the gravitation constant, and l is the measured wastewater level 13 of the tank 6. This calculation is only valid when the pump 5 is running, because the non-return valve 14 (see FIG. 3) needs to be open. This is solved by introducing small measurement cycles (see FIG. 5) in which the pump 5 is started and the pressure is measured. If the pressure is small enough the tank 6 will be emptied, otherwise the pump 5 is stopped.

Figure 6:
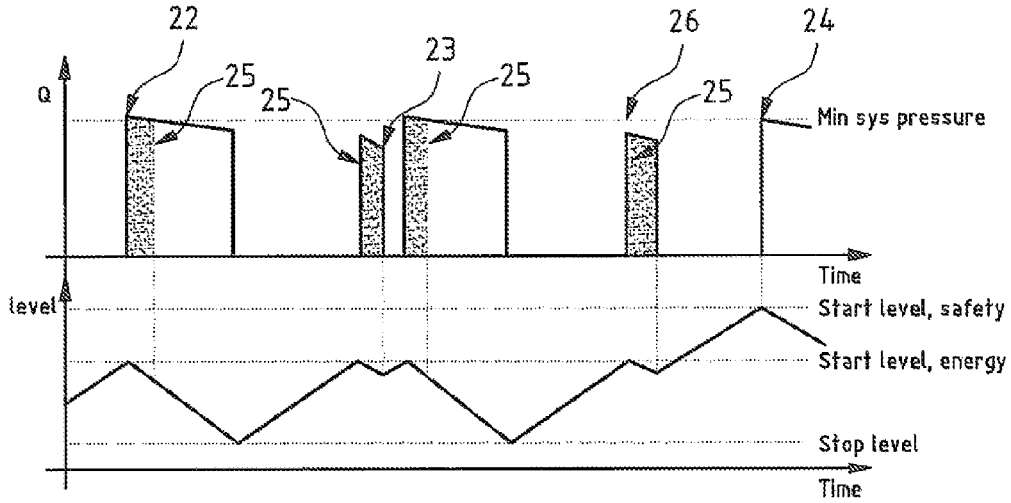
FIG. 6 is a graph showing another control example for a case in which the pump flow is used.

FIG. 6 shows a further control example in which the parameter expressing the load of the wastewater pumping network 1 is the pump flow Q which is used to start the pump 5 in the energy optimization mode when the threshold 26 which here is represented by the maximum pump flow is passed. Here, a large pump flow indicates that there is no activity on the network meaning that the pressure in the common outlet pipe 3 (see FIG. 2) is expected to be low and the pump 5 might be started in the energy optimization mode. When the flow is smaller, i.e., below the minimum acceptable threshold value, the pump 5 should be stopped. The pump flow Q may be estimated from various signals measurable on the pump 5. For example, the pump power and speed and the motor current may be used to estimate this value.

Figure 7:
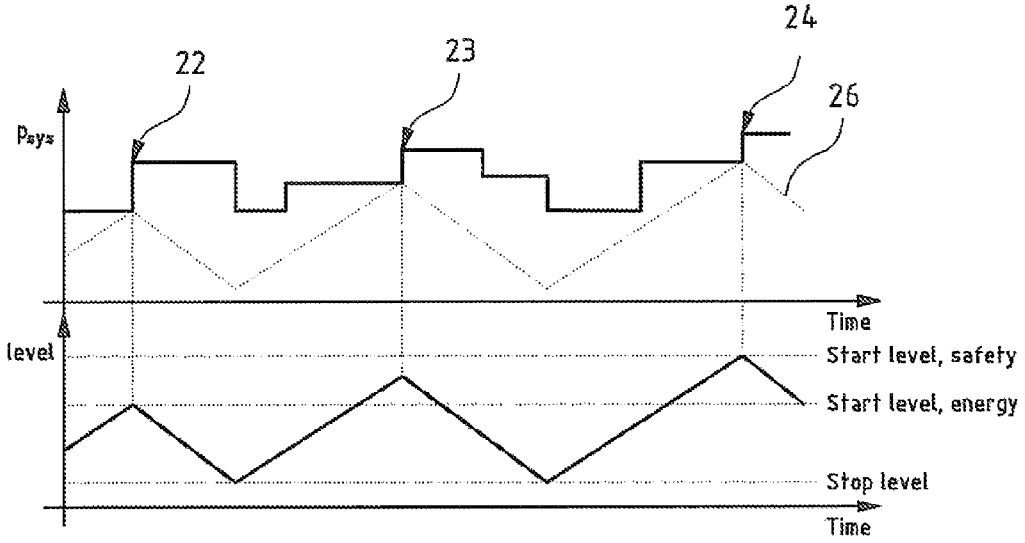
FIG. 7 is a graph showing another control example with a variable threshold.

FIG. 7 shows another control example with a variable threshold 26.

Instead of having a threshold 26 with a constant value, it is in some cases beneficial to let the threshold 26 for starting the pump 5 be a function of, for example, time. For example, if it is required to empty the tank 6 each day and use the pressure as the parameter expressing the load of the network, the pressure threshold 26 for starting the pump 5 could be increased, meaning that the probability of starting the pumps 5 is increased.

In another implementation, the threshold 26 for the system pressure could be a function of the level in the tank 6. Then, if the level is low, the threshold 26 is also low, meaning that the pump 5 will only start if the energy consumption of pumping is very small. As the level increases, the threshold 26 for the system pressure is also increased, meaning that the pump 5 starts under less efficient conditions. The less efficient operation is accepted, because it is becoming more and more important that the tank 6 is emptied. A figure presenting this idea is shown in FIG. 7.

However, both of the above described methods can, of cause, be used together with the other control schemes shown in FIGS. 5 and 6.

It would also be a good approach to run the pump 5 at different speeds dependent on the pressure of the main pipeline. This is, in fact, necessary if the pump 5 should run with minimum specific energy, wherein the specific energy is given by $$E_{sp} = \frac{E}{V}$$

where E is the energy consumed over a fixed time interval and V is the pumped volume on the same interval.

Figure 8:
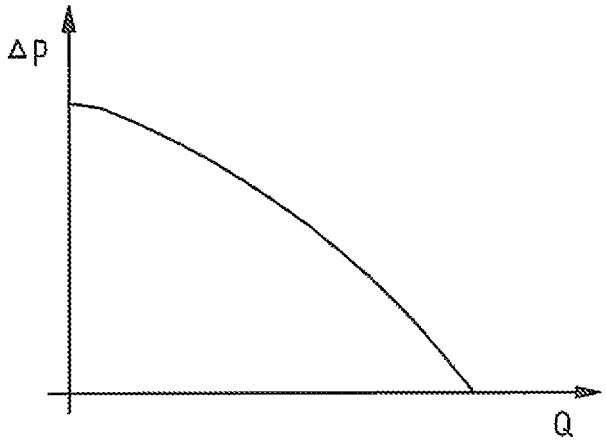
FIG. 8 is a graph showing the relation between the pump pressure and the pump flow.

FIG. 8 shows the relation between the pump pressure ΔP and the pump flow Q. The relation between the outlet pressure of the pump $p_{outlet}$ which essentially corresponds to $p_{sys}$, and the pressure across the pump ΔP is given by the following equation:

$$P_{sys} = \Delta P - \rho g l$$

This means that at a wastewater level 13 close to the "start level, energy" (third level 21), the pump pressure is close to proportional to the network pressure. This means that a "low" flow value can be used as an indicator for the activity in the network. There is no flow in the system unless the pump 5 is running. Therefore, measurement cycles are necessary for this approach (see FIG. 6).

Figure 9:
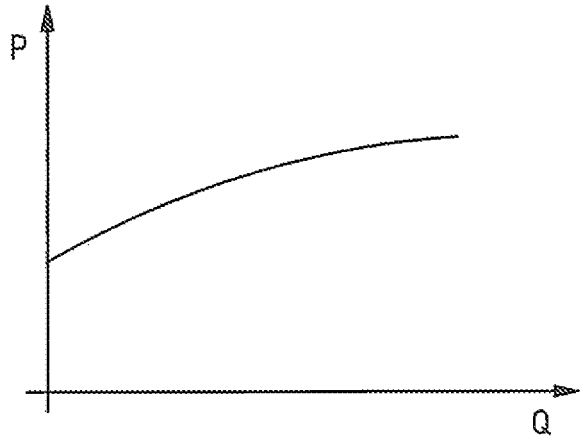
FIG. 9 is a graph showing the relation between the pump flow and the pump power.

FIG. 9 shows the relation between the pump flow Q and the pump power P. As can be seen, the relation between the pump power P and the pump flow Q here is monotone. The monotone relationship means that the power P could be used as an alternative to the flow Q in the control approach presented in FIG. 6. The power P is a measurement that indicates the load of the pump 5. Other signals that indicate the load are the motor current or cos phi of the motor. Finally, it should be noted that the pump flow can be estimated from the change in the wastewater level 13 in the tank 6 by using the following equation:

$$Q = \frac{A}{\Delta t}(l_t - l_{t-\Delta t})$$

wherein A is the area of the tank 6, Δt is the time between measurements, $l_t$, is the wastewater level 13 at time t and $l_{t-\Delta t}$ is the wastewater level 13 at time t−Δt. Here, the flow Q is the difference between the inflow into the tank 6 and the pump flow. This means that the pump flow can be determined by calculating the flow just before the pump is turned on, and subtract this value from the flow calculated after the pump is turned on. This flow difference can be used as the flow in the procedure shown in FIG. 6.

As an alternative to the flow calculation based on tank information and fixed time steps as shown in the equation above, it is possible to fix the change of level and calculate the time between levels as an expression for the flow. This leads to the following equation:

$$Q = \frac{A}{t_l - t_{l-\Delta l}}\Delta l$$

The difference between this and the previous equation is that in the previous equation the time difference Δt is constant, whereas in the current equation, the distance Δ1 is constant. Even though pit based flow estimation is presented, the most natural way to obtain flow information is to estimate the flow from the pump curves shown in FIGS. 8 and 9.

The threshold value 26 with which the load expressing parameter $P_{sys}$ is compared, is preferably generated automatically. More specifically, when initializing the wastewater pumping station 2, the first ten activations of the pump 5 are accompanied with a determination of the magnitude of the pressure $P_{sys}$. The ten magnitudes are logged by the control unit 9', and the lowest value (which equals low pressure in outlet pipe 3) is selected as the threshold value 26. A similar approach can be made when using, e.g., the pump flow Q as the parameter expressing the load of the system network. Additionally to using only the first ten activations for storage in the log, a continuously updated log can be used. This means that, e.g., always the magnitude of the parameter of the latest ten pump activations is stored and used for determining the threshold 26.

Figure 10:
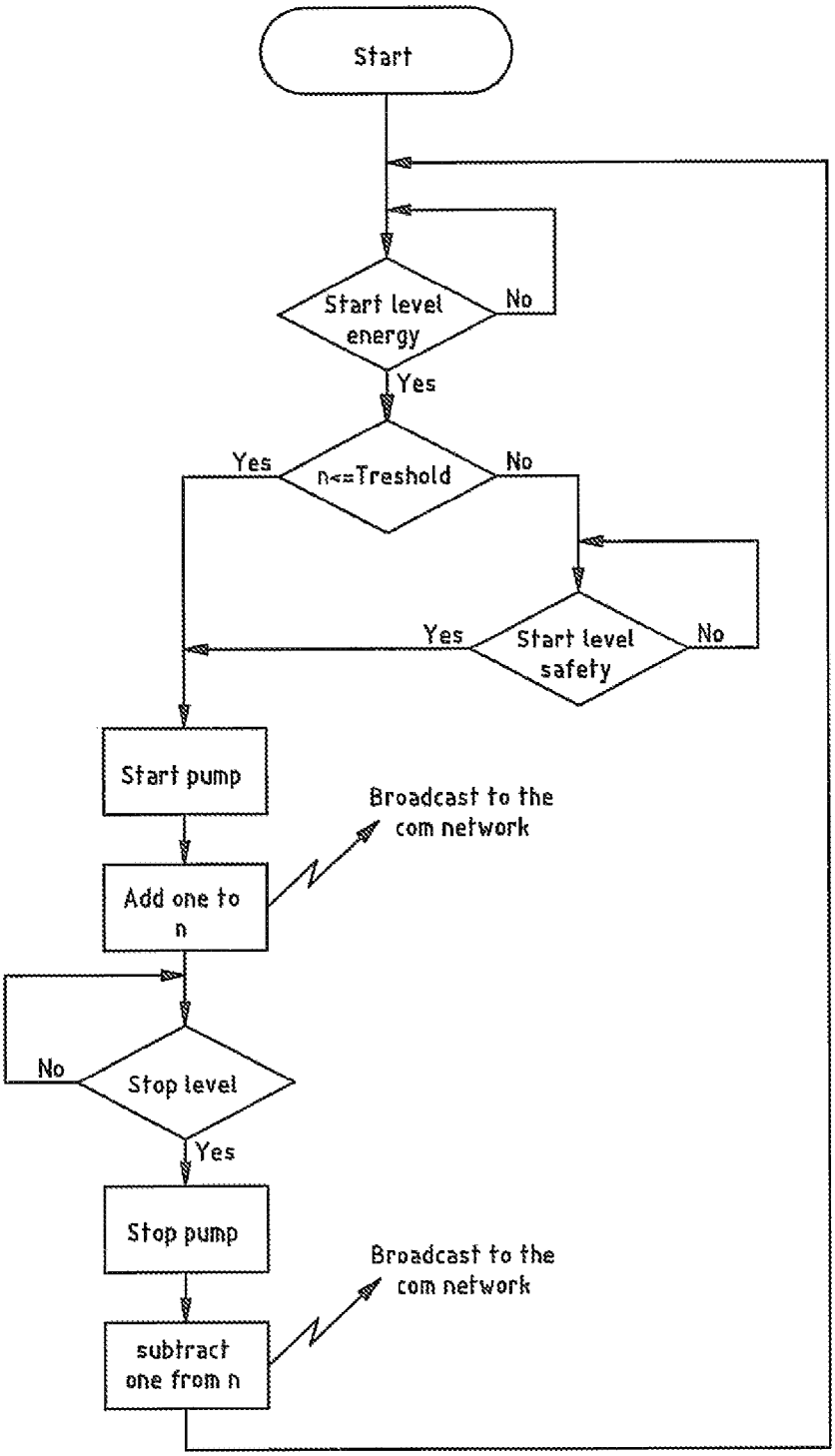
FIG. 10 is a flow chart of the operation of a pump in a wastewater pumping network.

FIG. 10 shows a flow chart of the operation of a pump 5 in a wastewater pumping network 1 as shown, e.g., in FIG. 2. It is assumed that the pumps 5 are connected via a communication network that enables all pumps 5 to send information to other pumps 5 of the wastewater pumping network 1. The number of active pumps 5 is stored in each pump 5 in a counter P. The counter P is controlled by broadcasting information on the communication network each time a pump 5 is turned on or off. As can be seen in the flow chart, first it is determined if the "start level, energy", namely, the third level 21 has been reached. If it has not been reached, the procedure returns to the start point. If it has been reached, it is determined if the number of pumps n is lower or equal to a certain threshold. If it is higher than the threshold value, then it is determined if the "start level, safety", namely, the first level 19 has been reached. If the "start level, safety" has been reached, the pump is started and the counter P is incremented by 1. This information is distributed via the network to all other pumps 5. Then, if it is determined, if the "stop level", namely, the second level 20 has been reached, the pump 5 will be stopped and the counter P will be decreased by 1. Again, this information is provided to all other pumps over the communication network.

It should be noted that in a centralized solution in which all pumps 5 are controlled by a central control unit 9, the counter n may be located at 10 the central control unit 9 so that only one instant of n is necessary. In this case, each pump 5 would need to ask the central control unit 9 for a permission to start pumping when the third level 21, namely, the "start level, energy" is reached. In the method shown in FIG. 10, there is no need for measuring pressure or flow. The parameter expressing the load of the waste water pumping network is n, and the higher ni, the higher is the number of active pumps, and hence, the traffic in the network. According to the invention, energy savings can be obtained by stopping pumps or delaying activation of pumps until n is below the specified threshold.

While specific embodiments of the invention have been shown and described in detail to illustrate the application of the principles of the invention, it will be understood that the invention may be embodied otherwise without departing from such principles.

What is claimed is:

1. A method for operating a wastewater pumping station of a wastewater pumping network, the wastewater pumping station comprising at least one pump, wherein the at least one pump starts pumping if a level of the wastewater in a tank of the wastewater pumping station exceeds a first wastewater level, and the at least one pump stops pumping if the level of the wastewater in the tank drops below a second level, the method comprising the steps of:

determining a magnitude of a parameter expressing the load in a common pipeline of the wastewater pumping network;

determining if the magnitude of the parameter expressing the load has passed a specified threshold; and activating the at least one pump to start pumping in an energy optimization mode if the parameter expressing the load has passed the specified threshold, wherein the specified threshold of the load expressing parameter is determined by measuring or deriving the size or value of the parameter during each of a plurality of activations of the at least one pump to provide a plurality of sizes or values of the parameter, and then selecting or calculating the specified threshold on the basis of the sizes or values.

2. A method according to claim 1, wherein the parameter comprises a pressure detected in a common outlet pipe of the wastewater pumping network.

3. A method according to claim 1, wherein the step of activating the at least one pump is performed only if a specified third wastewater level has been met or exceeded.

4. A method according to claim 1, wherein each pump is driven by an electric motor and the parameter expressing the load is at least one of the following: a system pressure (Psys); a pump flow (Q); a number of pumps (n) active in the system; a differential pressure (ΔP) over the at least one pump; an electrical power ($P_{electrical}$) used by the at least one pump; a power factor (cos (ϕ)) of the at least one electrical motor; and an electrical current (I) of the at least one motor.

5. A method according to claim 2, wherein in the energy optimization mode if it is determined that the pressure exceeds a specified upper pressure limit, the at least one pump is deactivated.

6. A method according to claim 2, wherein the method further comprises a step of increasing or decreasing, in the energy optimization mode, the speed of the at least one pump in accordance to the pressure detected.

7. A method according to claim 2, wherein:

the pressure is a fluid pressure of the wastewater in a common outlet pipe of the wastewater pumping network; and wherein the pressure is detected by measuring the pressure, by means of a pressure sensor, to measure an absolute pressure or a pressure difference, in the common outlet pipe, to which the wastewater pumping station is connected.

8. A method according to claim 1, wherein a pressure is determined by determining a pressure difference across the at least one pump, and determining a wastewater level in the tank, the at least one pump being accommodated in the tank.

9. A method according to claim 8, wherein the step of determining the pressure difference across the at least one pump comprises determining the flow of pumped wastewater based on changes in the wastewater level in the tank, or based on the electric power or speed of the at least one pump.

10. A method according to claim 2, wherein detecting the pressure comprises determining one or more of the power of a drive motor used for driving the at least one pump and a power factor (cos(ϕ)).

11. A method according to claim 2, wherein the method further comprises a step of individually controlling the at least one pump based on the pressure detected by a local pump controller.

12. A method according to claim 1, wherein the at least one pump is centrally controlled from a central control station of the wastewater pumping network.

13. A method according to claim 1, wherein the wastewater pumping network comprises a plurality of wastewater pumping stations.

14. A control unit for a wastewater pumping station of a wastewater pumping network comprising a plurality of wastewater pumping stations, at least one of the wastewater pumping stations comprising at least one pump adapted to pump wastewater from a tank to a common outlet pipe of the wastewater pumping network, the control unit being configured to:

control the at least one pump to start pumping if a wastewater level exceeds a first level in the tank, and to stop pumping if the level of the wastewater drops below a second level in the tank;

control the activity of the at least one pump in an energy optimization mode on the basis of a determined parameter expressing the load in the common pipeline of the wastewater pumping network;

determine if a magnitude of the parameter expressing the load has passed a specified threshold;

activate the at least one pump to start pumping in an energy optimization mode if the parameter expressing the load has passed the specified threshold;

activate the at least one pump a plurality of times to provide a plurality of activations of the at least one pump;

measure or derive a size or value of the parameter during each of said plurality of activations of the at least one pump to provide at least a plurality of sizes or values of the parameter; and determine the specified threshold based on at least said plurality of sizes or values of the parameter.

15. A control unit according to claim 14, wherein the control unit is further adapted to increase or decrease the speed of the at least one pump on the basis of a pressure determined, wherein the control unit is further configured to activate the at least one pump in said energy optimization mode only if a third wastewater level is met or exceeded and the parameter expressing the load has passed the specified threshold, said third wastewater level being between said first wastewater level and said second wastewater level, said first wastewater level being a maximum wastewater level of the tank and said second level being a minimum wastewater level of the tank.

16. A method according to claim 14, wherein the at least one pump is started if said parameter is calculated by measurement of a differential pressure of the at least one pump or measurement of a flow through the at least one pump.

17. A wastewater pumping system comprising:

a wastewater pumping network with at least one wastewater pumping station comprising a common pipeline, a tank and at least one pump, the tank being connected to the common pipeline; and a control unit connected to the at least one pump, the control unit being configured to:

control the at least one pump to start pumping if a wastewater level exceeds a first level in the tank, and to stop pumping if the level of the wastewater drops below a second level in the tank;

control the activity of the at least one pump in an energy optimization mode on the basis of a determined parameter expressing the load in the common pipeline of the wastewater pumping network;

determine if a magnitude of the parameter expressing the load has passed a specified threshold;

activate the at least one pump to start pumping in an energy optimization mode if the parameter expressing the load has passed the specified threshold;

measure or derive a size or value of the parameter during each of a plurality of activations of the at least one pump to provide at least a plurality of measured sizes or values of the parameter; and determine the specified threshold based on at least said plurality of measured sizes or values of the parameter.

18. A system according to claim 17, further comprising a pressure detection arrangement at one of the at least one pump and the common outlet pipe of the wastewater pumping network wherein the control unit is further adapted to increase or decrease the speed of the at least one pump on the basis of a pressure determined, wherein the control unit is further configured to activate the at least one pump in said energy optimization mode only if a third wastewater level is met or exceeded and the parameter expressing the load has passed the specified threshold, said third wastewater level being between said first wastewater level and said second wastewater level, said first wastewater level being a maximum wastewater level of the tank and said second level being a minimum wastewater level of the tank, the wastewater pumping network comprising all a pipe system.

19. A method according to claim 17, wherein each pump is driven by an electric motor and the parameter expressing the load is at least one of the following: a system pressure (Psys); a pump flow (Q); a number of pumps (n) active in the system; a differential pressure ($\Delta P$) over the at least one pump; an electrical power ($P_{electrical}$) used by the at least one pump; a power factor ($\cos(\phi)$) of the at least one electrical motor; and an electrical current (I) of the at least one motor.

20. A system according to claim 17, wherein in the energy optimization mode at least one of:

the at least one pump is deactivated if it is determined that the pressure exceeds a specified upper pressure limit; and the speed of the at least one pump is increased or decreased in accordance to the pressure detected.

* * * * *